US011391554B2

(12) United States Patent
Du

(10) Patent No.: US 11,391,554 B2
(45) Date of Patent: Jul. 19, 2022

(54) FIRECRACKER PACKAGE

(71) Applicant: Jianshan Du, Guilin (CN)

(72) Inventor: Jianshan Du, Guilin (CN)

( * ) Notice: Subject to any disclaimer, the term of this patent is extended or adjusted under 35 U.S.C. 154(b) by 142 days.

(21) Appl. No.: 16/517,764

(22) Filed: Jul. 22, 2019

(65) Prior Publication Data

US 2021/0003375 A1 Jan. 7, 2021

(30) Foreign Application Priority Data

Jul. 2, 2019 (CN) ..... 201921019596.4

(51) Int. Cl.
*F42B 39/24* (2006.01)
*F42B 39/26* (2006.01)
*F42B 4/04* (2006.01)

(52) U.S. Cl.
CPC ..... *F42B 39/24* (2013.01); *F42B 39/26* (2013.01); *F42B 4/04* (2013.01)

(58) Field of Classification Search
CPC ..... B65D 1/24; B65D 1/36; B65D 75/325; B65D 75/327; F42B 4/04; F42B 39/24; F42B 39/26
USPC ..... 206/3
See application file for complete search history.

(56) References Cited

U.S. PATENT DOCUMENTS 3,227,084 A * 1/1966 Stokes ..... F42B 4/22 102/361
5,685,420 A * 11/1997 Martin ..... B65D 5/48024 206/497
7,395,922 B1 * 7/2008 Sinha ..... F42B 39/26 206/3
2013/0118922 A1 * 5/2013 McClaughry ..... B65B 5/08 206/3

FOREIGN PATENT DOCUMENTS

EP 2090526 A1 * 8/2009 ..... B65D 75/327
WO WO-2018000384 A1 * 1/2018 ..... B65D 85/00

* cited by examiner

*Primary Examiner* — Ernesto A Grano

(57) ABSTRACT

A firecracker package includes a packaging box body, a packaging component, and a buffering material. The packaging component is provided in the packaging box body and is used for firecracker packaging, and the buffering material is provided between the packaging box body and the packaging component and is used for absorbing the impact and preventing explosion. The firecrackers have a good impact absorption and explosion-proof effect during transportation or consumption, which avoids the explosion caused by extrusion, and improves the safety performance. Moreover, the sealing effect is promoted, the waterproof and moisture resistance performance is stronger, the expiry date is prolonged, and the environmental pollution is avoided.

10 Claims, 3 Drawing Sheets

FIRECRACKER PACKAGE

CROSS REFERENCE TO THE RELATED APPLICATIONS

This application is based upon and claims priority to Chinese Patent Application No. CN 201921019596.4, filed on Jul. 2, 2019, the entire contents of which are incorporated herein by reference.

TECHNICAL FIELD

The present disclosure relates to the field of firecracker packaging technology, in particular to a firecracker package.

BACKGROUND

Fuseless firecrackers refer to fireworks without a fuse, which has become popular with consumers in the fireworks market due to the user-friendly operation thereof and the bursting sound generated by throwing the fuseless firecrackers onto the ground.

The fuseless firecrackers available on the present market are packaged in the manner of placing a plurality of firecrackers in packaging bags and filling the packaging bags with a large amount of sawdust to prevent explosions caused by collisions. However, the firecrackers packaged by this means are loose and fail to completely separate from each other. During transportation or consumption, the firecrackers are prone to mutually colliding, which causes explosion accidents, and low security. During the normal consumption, there is a lot of sawdust, which is likely to pollute the environment. Meanwhile, the packaging bags have a poor sealing and the firecrackers are susceptible to dampness. Therefore, the existing packaging has a need for improvement.

SUMMARY

The present disclosure provides a firecracker package to address the above-mentioned technical problems.

In order to resolve the above-mentioned technical problems, the technical solution of the present disclosure is as follows.

A firecracker package includes a packaging box body, a packaging component provided in the packaging box body and used for firecrackers packaging, and a buffering material provided between the packaging box body and the packaging component, to absorb the impact and prevent explosion The firecracker package, wherein the packaging component includes:

a placing plate, wherein placing grooves for placing the firecrackers are provided on the placing plate; and a packaging film, wherein the packaging film is provided on a top of the placing grooves on the placing plate, and configured to seal the placing grooves to package the firecrackers.

The firecracker package, wherein a plurality of the placing grooves is provided, and the plurality of placing grooves are equidistantly arranged on the placing plate.

The firecracker package, wherein the plurality of placing grooves are distributed in rows on the placing plate.

The firecracker package, wherein a plurality of buffering materials are provided, and the packaging component is provided between two adjacent buffering materials.

The firecracker package, wherein a thickness of the buffering material is 3 to 10 mm, and an overall structure of the buffering material is matched with a shape of the packaging component.

The firecracker package, wherein the buffering material is composed of any one or several of a rubber mat, a silica gel mat, a pearl cotton, and a foamed plastic.

The firecracker package, wherein the packaging box body is made of a cardboard, a plastic or a board.

Compared with the prior art, the advantages of the present disclosure are as follows:

The firecracker package includes the packaging box body, the packaging component, and the buffering material, wherein the packaging component is provided in the packaging box body and is used for packaging the firecrackers, and the buffering material is provided between the packaging box body and the packaging component and is used for absorbing the impact and preventing explosion. As a result, the firecrackers have a good impact absorption and explosion-proof effect during transportation and consumption, which avoids the explosion caused by extrusions and improves the safety performance. Moreover, the sealing effect of the firecracker package is improved, the waterproof and moisture resistance performance is stronger, the expiry date is prolonged, and the environmental pollution is avoided.

BRIEF DESCRIPTION OF THE DRAWINGS

In order to more clearly illustrate the technical solutions in the embodiments of the present disclosure, the drawings in the description of the embodiments will be briefly described hereinafter.

DETAILED DESCRIPTION OF THE EMBODIMENTS

Referring to FIGS. 1 to 5, the firecracker package includes the packaging box body 1, the packaging component 2, and the buffering material 3. The packaging component 2 is provided in the packaging box body 1 and is used for packaging the firecrackers 10. The buffering material 3 is provided between the packaging box body 1 and the packaging component 2 and is used for absorbing the impact and preventing explosion.

The firecracker package includes the packaging box body 1, the packaging component 2, and the buffering material 3. Specifically, the packaging component 2 is provided in the packaging box body 1 and is used for packaging firecrackers 10. The buffering material 3 is provided between the packaging box body 1 and the packaging component 2 and is used for absorbing the impact and preventing explosion. During transportation or consumption, the firecrackers have a good impact absorption and explosion-proof effect, which avoids the explosion caused by extrusions, and improves the safety performance. Moreover, the product sealing effect is improved, the waterproof and moisture resistance performance is stronger, the expiry date is prolonged, and the environmental pollution is avoided.

Figure 3:
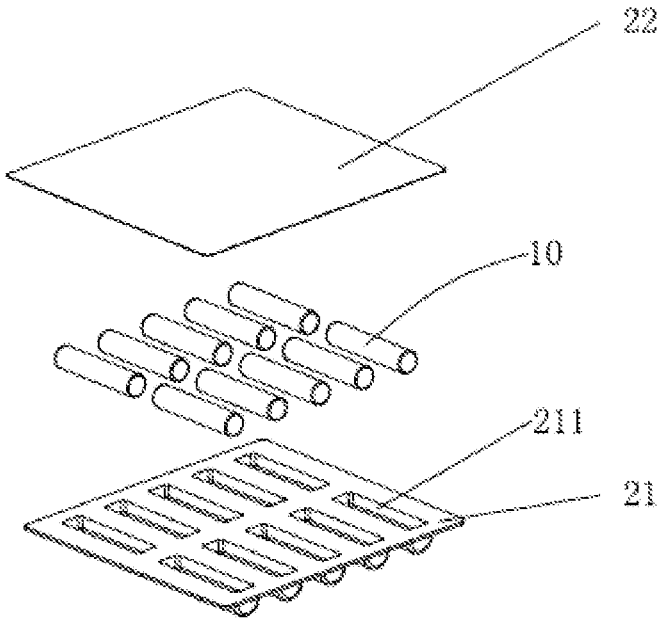
FIG. 3 is an exploded view of the packaging component 2 of Embodiment 1 of the present disclosure.
Figure 4:
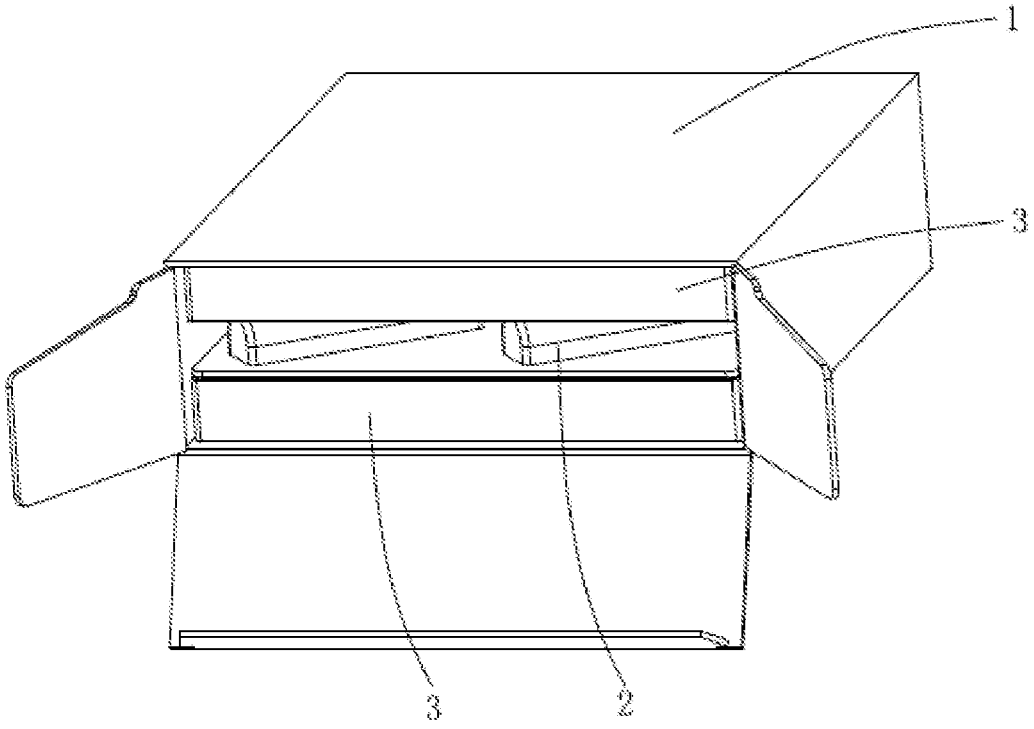
FIG. 4 is a perspective view of Embodiment 2 of the present disclosure.

The packaging component 2 includes the placing plate 21 and the packaging film 22. The placing grooves 211 for placing firecrackers 10 are provided on the placing plate 21. The packaging film 22 is provided on the top of the placing grooves 211 on the placing plate 21 and is used to seal the placing grooves 211 to package the firecrackers 10. As shown in FIG. 3, the placing grooves 211 are configured to separately package the firecrackers, so as to avoid the explosion caused by extrusions, and improve the safety performance. Moreover, the packaging film 22 is configured to improve the sealing effect of the firecracker package, enhance the waterproof and moisture resistance performance, and prolong the expiry date. Moreover, the scattering of the sawdust generated by opening the existing package is eliminated, which meets the requirements of environmental protection, and avoids the environmental pollution. Preferably, the packaging film 22 is an aluminum foil layer and is provided with a tearing portion. The tearing portion is configured to open the packaging film 22, which facilitates in taking out the firecrackers 10.

The plurality of the placing grooves 211 are equidistantly arranged on the placing plate 21, which aims to package the plurality of firecrackers, and to separate the firecrackers one by one. Consequently, the explosion caused by extrusions can be avoided, the safety performance is improved. Further, the firecrackers are separately taken out to avoid damping when opened at the same time.

Figure 1:
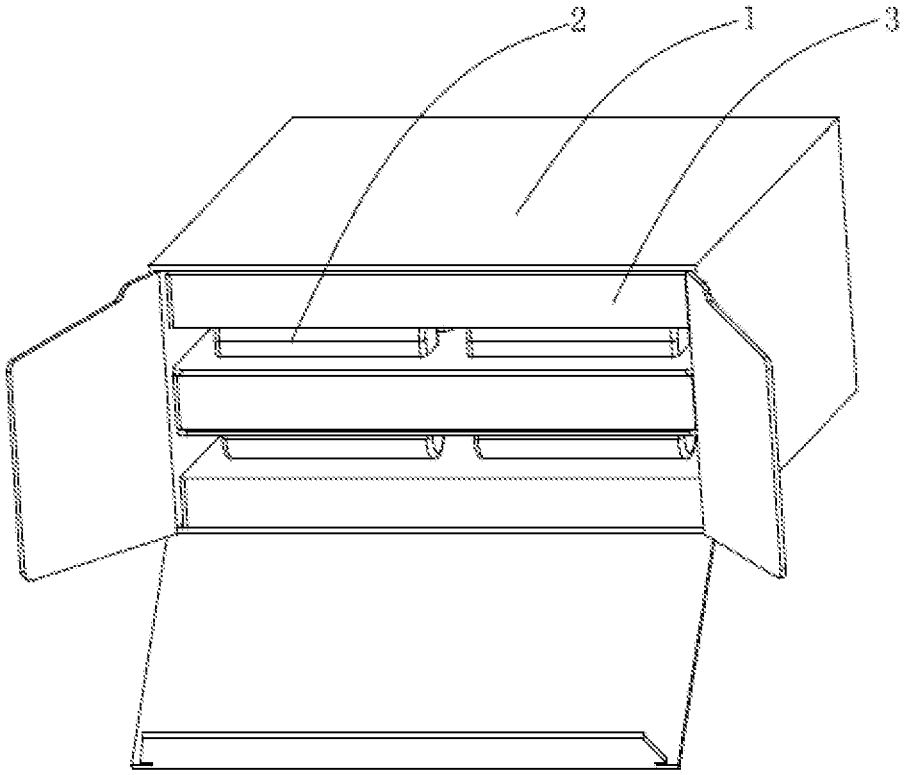
FIG. 1 is a perspective view of Embodiment 1 of the present disclosure.
Figure 2:
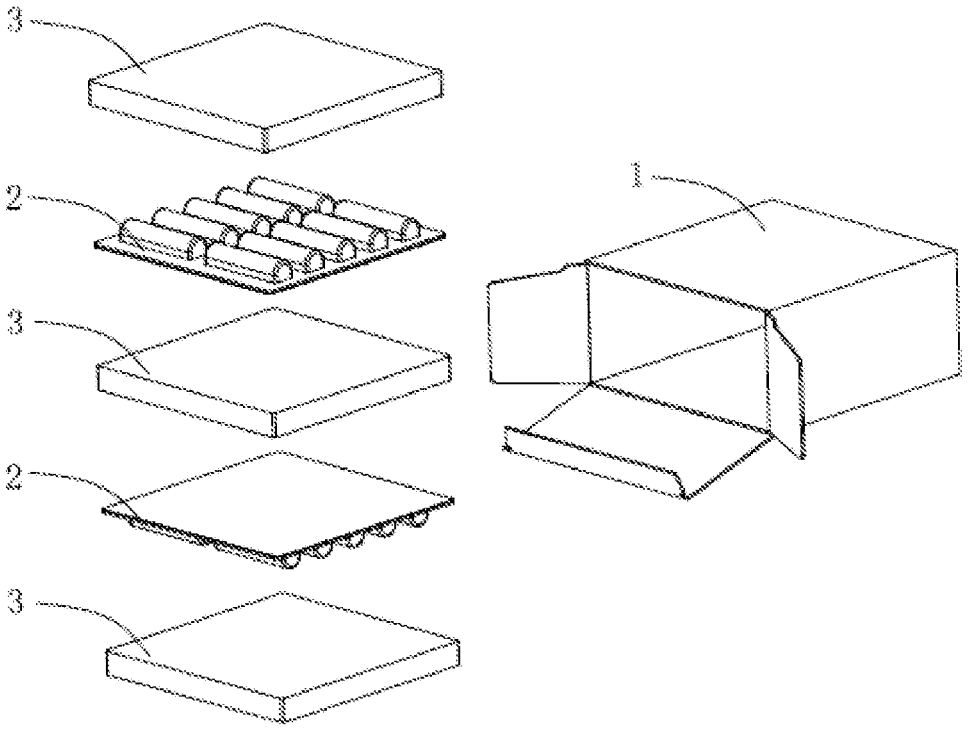
FIG. 2 is an exploded view of Embodiment 1 of the present disclosure.
Figure 5:
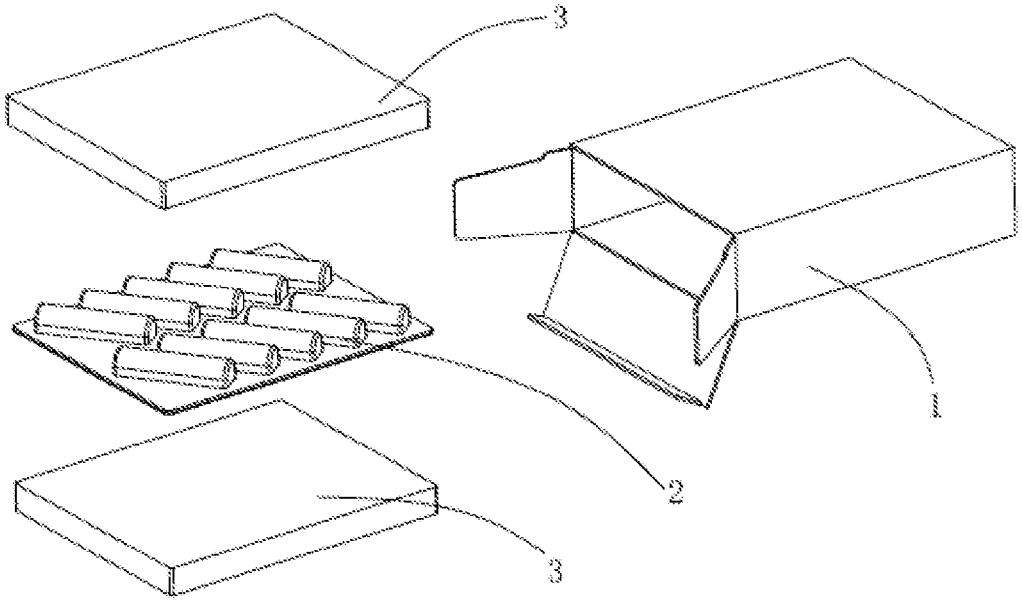
FIG. 5 is an exploded view of Embodiment 2 of the present disclosure.

The placing grooves 211 are provided in rows on the placing plate 21. As shown in FIG. 2, in Embodiment 1, the two rows of the placing grooves 211 are vertically provided on the placing plate 21, which can increase the storage amount of the firecrackers. As shown in FIG. 5, in Embodiment 2, the two rows of the placing grooves 211 are obliquely provided on the placing plate 21, which facilitates in taking out the firecrackers. Certainly, the placing grooves 211 can be arranged in multiple rows, or arranged in a V shape or other ways.

The plurality of the buffering materials 3 are provided. The packaging component 2 is provided between two adjacent buffering materials 3. The buffering material 3 is provided on both sides of the packaging component 2, which achieves the impact absorption and explosion-proof effect, avoids the explosion caused by the extrusions, and improves the safety performance.

The thickness of the buffering material 3 is 3 to 10 mm, and the overall structure of the buffering material 3 is matched with the shape of the packaging component 2, which functions as a shock absorber and buffer.

The buffering material 3 is composed of any one or several of a rubber mat, a silica gel mat, a pearl cotton, and a foamed plastic. The buffering material 3 is preferably pearl cotton, which has the advantages of impact absorption, explosion proof, moisture resistance and strong impact resistance.

The packaging box body 1 is made of a cardboard, a plastic or a board, which has a good hardness, plays the role of outer packaging and explosion proof. Preferably, the shape of the packaging box body 1 is square.

The firecracker package includes the packaging box body 1, the packaging component 2, and the buffering material 3. Specifically, the packaging component 2 is provided in the packaging box body 1 and is used for packaging firecrackers 10. The buffering material 3 is provided between the packaging box body 1 and the packaging component 2 and is used for absorbing the impact and preventing explosion. During transportation or consumption, the firecrackers have a good impact absorption and explosion-proof effect, which avoids the explosion caused by extrusions, and improves the safety performance. Moreover, the product sealing effect is improved, the waterproof and moisture resistance performance is stronger, the expiry date is prolonged, and environmental pollution is avoided.

What is claimed is:

1. A package with firecrackers, comprising:

a packaging box body having a first inner surface and an opposing second inner surface, the packaging box body being made of a cardboard, a plastic or a board;

a first buffering material having a first side in contact with the first inner surface of the packaging box body and an opposing second side;

a first packaging component having a first side in contact with the second side of the first buffering material and an opposing second side;

a second buffering material having a first side in contact with the second side of the first packaging component and an opposing second side;

a second packaging component having a first side in contact with the second side of the second buffering material and an opposing second side;

a third buffering material having a first side in contact with the second side of the second packaging component and an opposing second side in contact with the second inner surface of the packaging box body;

wherein an overall structure of each of the first buffering material, the second buffering material, and the third buffering material is matched with a shape of the first packaging component and the second packaging component;

wherein each of the first buffering material, the second buffering material, and the third buffering material is composed of one or more of a rubber mat, a silica gel mat, a pearl cotton, and a foamed plastic;

wherein a thickness of each of the first buffering material, the second buffering material, and the third buffering material is between 3 mm to 10 mm;

wherein each of the first buffering material, the second buffering material, and the third buffering material is provided for absorbing an impact and preventing an explosion;

wherein each of the first packaging component and the second packaging component comprises:

a placing plate with a plurality of placing grooves provided thereon, the plurality of placing grooves extending in a lengthwise direction along a surface of the placing plate and each placing groove receiving a firecracker; and a packaging film provided on the surface of the placing plate and the plurality of placing grooves to seal the plurality of placing grooves to package each firecracker into a corresponding placing groove;

wherein the packaging film of the first packaging component is in direct contact with the first side of the second buffering material; and the packaging film of the second packaging component is in direct contact with the second side of the second buffering material.

2. The package according to claim 1, wherein each of the first buffering material, the second buffering material, and the third buffering material is a pearl cotton.

3. The package according to claim 1, wherein each two immediately neighboring placing grooves of the plurality of placing grooves are equally spaced apart from each other and arranged on the placing plate; wherein the packaging film comprises of an aluminum foil layer and is provided with a tearing portion.

4. The package according to claim 3, wherein the plurality of placing grooves are arranged in rows on the placing plate.

5. The package according to claim 1, wherein the plurality of placing grooves are obliquely provided in rows on the placing plate.

6. A firecracker package, comprising:

a packaging box body having a first inner surface and an opposing second inner surface, the packaging box body being made of a cardboard, a plastic or a board;

a first buffering material having a first side in contact with the first inner surface of the packaging box body and an opposing second side;

a first packaging component having a first side in contact with the second side of the first buffering material and an opposing second side;

a second buffering material having a first side in contact with the second side of the first packaging component and an opposing second side;

a second packaging component having a first side in contact with the second side of the second buffering material and an opposing second side;

a third buffering material having a first side in contact with the second side of the second packaging component and an opposing second side in contact with the second inner surface of the packaging box body;

wherein an overall structure of each of the first buffering material, the second buffering material, and the third buffering material is matched with a shape of the first packaging component and the second packaging component;

wherein each of the first buffering material, the second buffering material, and the third buffering material is composed of one or more of a rubber mat, a silica gel mat, a pearl cotton, and a foamed plastic;

wherein a thickness of each of the first buffering material, the second buffering material, and the third buffering material is between 3 mm to 10 mm;

wherein each of the first buffering material, the second buffering material, and the third buffering material is provided for absorbing an impact and preventing an explosion;

wherein each of the first packaging component and the second packaging component comprises:

a placing plate with a plurality of placing grooves for receiving firecrackers and provided thereon, the plurality of placing grooves extending in a lengthwise direction along a surface of the placing plate; and a packaging film provided on the surface of the placing plate and the plurality of placing grooves to seal the plurality of placing grooves;

wherein the packaging film of the first packaging component is in direct contact with the first side of the second buffering material; and the packaging film of the second packaging component is in direct contact with the second side of the second buffering material.

7. The package according to claim 6, wherein each of the first buffering material, the second buffering material, and the third buffering material is a pearl cotton.

8. The package according to claim 6, wherein each two immediately neighboring placing grooves of the plurality of placing grooves are equally spaced apart from each other and arranged on the placing plate; wherein the packaging film comprises of an aluminum foil layer and is provided with a tearing portion.

9. The package according to claim 8, wherein the plurality of placing grooves are arranged in rows on the placing plate.

10. The package according to claim 6, wherein the plurality of placing grooves are obliquely provided in rows on the placing plate.

* * * * *